United States Patent [19]

Hosaka et al.

[11] Patent Number: 4,668,602

[45] Date of Patent: May 26, 1987

[54] INSTANT FILM UNIT

[75] Inventors: Shunichi Hosaka; Hiroyuki Kurabayashi; Jun Inose, all of Kanagawa, Japan

[73] Assignee: Fuji Photo Film Co., Ltd., Kanagawa, Japan

[21] Appl. No.: 766,135

[22] Filed: Aug. 15, 1985

[30] Foreign Application Priority Data

| | | | |
|---|---|---|---|
| Aug. 17, 1984 | [JP] | Japan | 59-171167 |
| Aug. 17, 1984 | [JP] | Japan | 59-171168 |
| Aug. 17, 1984 | [JP] | Japan | 59-171169 |
| Aug. 17, 1984 | [JP] | Japan | 59-171170 |

[51] Int. Cl.[4] ..... G03C 5/54; G03C 3/00

[52] U.S. Cl. ..... 430/207; 430/259; 430/263

[58] Field of Search ..... 430/207, 259, 263

[56] References Cited

U.S. PATENT DOCUMENTS

| | | | |
|---|---|---|---|
| 2,653,530 | 9/1953 | McCune | 430/207 |
| 2,659,673 | 11/1953 | Rogers et al. | 430/207 |
| 2,678,274 | 5/1954 | Rogers | 430/207 |

*Primary Examiner*—Richard L. Schilling

*Attorney, Agent, or Firm*—Young & Thompson

[57] ABSTRACT

A peel-apart type instant film unit comprising an image receiving sheet separably adhered in a heat sealing manner to a mask member which is peeled apart from the former after the development thereof. There is provided therebetween a weak sealing layer comprising an adhesive layer of a thermoplastic polymer having hydrophilic groups and a separating layer which is alkali resistant and has a good separation property relative to the adhesive layer. The weak sealing layer can provide an easy separation between the separating and adhesive layers so as perfectly to transfer the adhesive layer to the image receiving sheet to provide a fine appearance and a writeable image frame on the image receiving sheet. The mask member is made of any polyethylene compounded paper sheets and is provided with a processing liquid-resisting layer inside the weak sealing layer for the purpose of preventing the permeation of processing liquid thereto.

34 Claims, 5 Drawing Figures

INSTANT FILM UNIT

BACKGROUND OF THE INVENTION

1. Field of the Invention

The present invention relates to a peel apart type instant film unit.

2. Description of the Prior Art

As is well known in the art, the peel apart type instant film unit shown and illustrated in detail, for example, in Japanese Patent Publication No. 44-2528 (which is hereinafter referred to as a film unit) mainly comprises a photosensitive sheet having a photosensitive emulsion layer capable of having a developable latent image formed therein and an image receiving sheet adapted to provide a support for a positive transfer image produced, for example, by a diffusion-transfer reversal process. The photosensitive sheet is coupled to a carrier sheet and the image receiving sheet is mounted on a mask having a leading end connected to the carrier sheet.

After exposure, the film unit is withdrawn out of a film cassette or pack for superposing the sheets by drawing them through a pair of pressure applying rollers. At this time, a pod mounted on the carrier sheet is compressively ruptured for releasing a jellied processing liquid contained therein. The pressure applying rollers are adapted to distribute the processing liquid between the superposed sheets as the film unit is advanced therebetween for spreading the processing liquid in a thin, uniform layer. As is well known in the art of instant photography, upon the withdrawal of the film unit from a camera, the diffusion transfer process takes place exteriorly of the camera in a certain time. The sheets are then peeled apart form each other to reveal a desired reverse image in the image receiving sheet.

The mask, which is conventially made of any of the flexible sheet materials including kraft paper, glassine paper and the like, is provided with a weak sealing layer coated on the back surface thereof. The mask member is heat sealed to the image receiving sheet through the weak sealing layer. A conventional weak sealing layer comprises a separating layer coated on the back surface of the mask and an adhesive layer coated on the separating layer, which weak sealing layer is disclosed in U.S. Pat. Nos. 2,563,387, 2,659,673, and 2,678,274. In the above-mentioned U.S. Pat. No. 2,563,387, the material of the separating layer is zein of vegetable albumin with a triethylene glycol mixed as a plasticizer, as the adhesive agent is an ethylcellulose mixed with diethylphtalate as plasticizer. In the U.S. Pat. Nos. 2,659,673 and 2,678,274, polyvinyl alcohol is used for the separating agent and ethylcellulose mixed with either diethylphthalate or triphenyl phosphate as plasticizer is used for the adhesive agent. The adhesive strength between the mask and the separating layer and between the adhesive layer and the image receiving layer is intended to be greater than that between the separating layer and the adhesive layer for producing an easy and fine separation between the layers when the image receiving sheet is peeled apart from the mask in order to transfer the adhesive layer onto the image receiving sheet and thereby provide a frame with white color for defining an image area in the image receiving sheet.

One of problems in the conventional weak sealing layer is that parts of the adhesive layer are not transferred to the image receiving sheet and that the separating layer is partially exfoliated from the mask and clings to the image receiving sheet as well as the adhesive layer when the image receiving sheet is peeled apart from the mask after a predetermined separation time (which substantially equals to processing time) which is about 30 seconds in the case of a monochromatic film unit. As a result, the frame becomes dappled and fouled externally. It was recognized that the dapple mark becomes more severe as the separation time becomes longer. Furthermore, dapple marks appear at the peripheral region of the image area and harm image quality.

OBJECTS OF THE INVENTION

It is therefore a principal object of the present invention to provide an instant film unit in which a reliable separation is caused between separating and adhesive layers when a photosensitive sheet is peeled apart from an image receiving sheet so as perfectly to transfer the adhesive layer to the image receiving sheet and thereby to provide a frame having a fine appearance for defining an image area therein.

It is another object of the present invention to provide an instant film unit in which a reliable, easy separation is caused between separating and adhesive layers so as to transfer only the adhesive layer to the image receiving sheet even though the film unit is left for a long time.

It is still another object of the present invention to provide an instant film unit in which an image frame is writeable to inks.

It is a further object of the present invention to provide an instant film unit in which no dapple mark is produced along marginal portions of the image area in an image receiving sheet.

It is a still further object of the present invention to provide an instant film unit in which an easy separation can be caused between adhesive and separating layers, while the adhesive layer is well adhered to an image receiving sheet.

SUMMARY OF THE INVENTION

After having carried on the various investigations of the reasons owing to which the transferring property of an adhesive layer to an image receiving sheet becomes worse, the inventor discovered that the worsened transferring property results from a swollen weak sealing layer which comprises separating and adhesive layers. The weak sealing layer swells as processing liquid reaches the adhesive layer permeating through a mask and the separation layer during diffusion transfer processing. Therefore, the following countermeasures are considered to be effective:

(1) providing a weak sealing layer which withstands the swells;

(2) preventing the processing liquid from permeating into the weak sealing layer;

(3) increasing the adhesive strength between the adhesive layer and the image receiving sheet, while leaving the adhesive strength between the adhesive and the separating layer unchanged.

The above-mentioned countermeasures may be applied independently, but it will be more effective to apply any combination of the countermeasures.

The inventor has made various kinds of experiments for finding a favorable weak sealing layer in which an easy separation is caused between the adhesive layer and the separating layer. As a result, it was found that the easy separation can be caused by choosing combinations of agents for the adhesive layer and the separating layer. According to the present invention, thermoplastic polymers having hydrophilic groups are used for the adhesive layer, and polymers which have high alkaline resistance and are well separable from the adhesive layer are used for separating layer. According to a preferred embodiment of the present invention, for the purpose of the prevention of the permeation of processing liquid into the weak sealing layer, a mask member is made of a paper material containing polyethylene. The use of polyethlene compounded paper sheet for the mask member can avoid the production of ripple-like burrs in the mask member (which results from the expansion and contraction of the mask member owing to the permeation of processing liquid partially thereinto) and thereby the occurrence of dapple developing marks along the marginal portions of the image area in the image receiving sheet.

In accordance with a preferred embodiment of the present invention, a processing liquid-resisting layer is provided between the mask member and the weak sealing layer for the purpose of the prevention of the permeation of processing liquid into the weak sealing layer. It is effective to increase a heat seal property in order to prevent the exfoliation of adhesive layer from the image receiving sheet.

In order to provide a good heat seal property, it is preferable to use adhesives consisting of a base-polymer and a blend-polymer, an example of base polymer being polyimide or polyvinyl alcohol with a low degree of saponification, and an example of blend polymer being a copolymer of the following general formula:

Example of blend polymer is a copolymer of the following general formula (I):

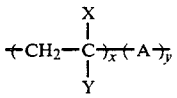

wherein X is hydrogen, halogen, cyano, or substituted or unsubstituted alkyl; Y is hydrogen, halogen, cyano, substituted or unsubstituted alkyl, aryl,

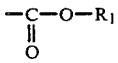

wherein $R_1$ is substituted or unsubstituted $C_{1-6}$ alkyl, or substituted or unsubstituted aryl,

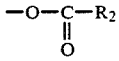

wherein $R_2$ is substituted or unsubstituted alkyl, or substituted or unsubstituted aryl,

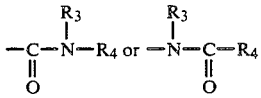

wherein $R_3$ and $R_4$ are hydrogen, substituted or unsubstituted alkyl, or substituted or unsubstituted aryl, and $R_3$ and $R_4$ can be the same or different; A is a repeating unit (monomer unit) derived from ethylenic unsaturated carboxylic acid, carboxylic acid salt thereof or carboxylic acid anhydride, which can be copolymerized with ethylenic series unsaturated monomer, respectively; and x and y are molar percentage of monomer component in copolymer having the following relations:

$$x+y=100,\ 0<x<60 \text{ and } 40\leqq y<100$$

Examples of substituted for substituted alkyl or substituted aryl are hydroxyl, carboxyl, halogen (preferably chloride), cyano, alkyl or aryl.

BRIEF DESCRIPTION OF THE DRAWINGS

These and other objects and advantages of the invention may be readily ascertained by referring to the description and accompanying drawings in which.

DETAILED DESCRIPTION OF THE INVENTION

Figure 4:
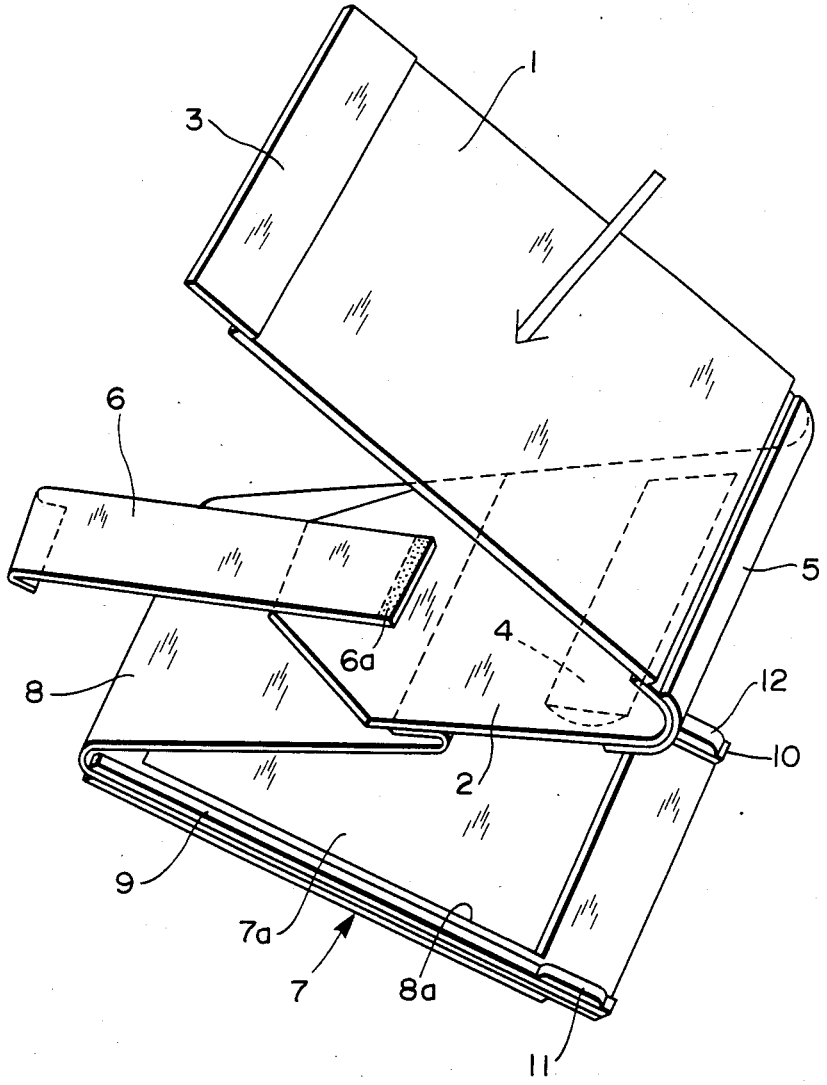
FIG. 4 is a perspective view of a film unit.

Referring now to FIG. 4, a film unit is shown in perspective in order better to illustrate the component parts and the manner in which the component parts are interconnected. Basically, the film unit includes a photosensitive sheet 1, an image receiving sheet 7 and a carrier sheet 2 interconnecting the sheets 1, 7. The photosensitive sheet 1 has a leading end to which the carrier sheet 2 is connected and a trailing end to which a trailer sheet 3 for trapping an excessive processing liquid is attached. Both of the carrier sheet 2 and the trailer sheet 3 are made of any carbon compounded sheet materials for surface reflection prevention. Adjacent the leading end of the photosensitive sheet 1, there are provided a pod 4 containing a processing liquid therein and a funnel 5 for guiding the processing liquid released from the pod 4, both of which are mounted on the carrier sheet 2. A pull tab 6 is detachably coupled to the carrier sheet 2 at its one end 6*a*.

The image receiving sheet 7 on which a picture image is provided is adhered to a mask 8 with weak sealing layer which has a low adhesive strength. The mask 8 is provided with a generally rectangular aperture 8*a* defining an image area in the image receiving sheet 7 and is connected to the carrier sheet 2 at its leading end. On both the lateral sides of the aperture 8*a*, band-shaped rail members 9, 10 made of relatively thick paper sheet are bonded. At their tail ends, the rail members 9, 10 are provided with plate-like projections 11, 12 respectively, which provide spaces for trapping the excess processing liquid.

Figure 5:
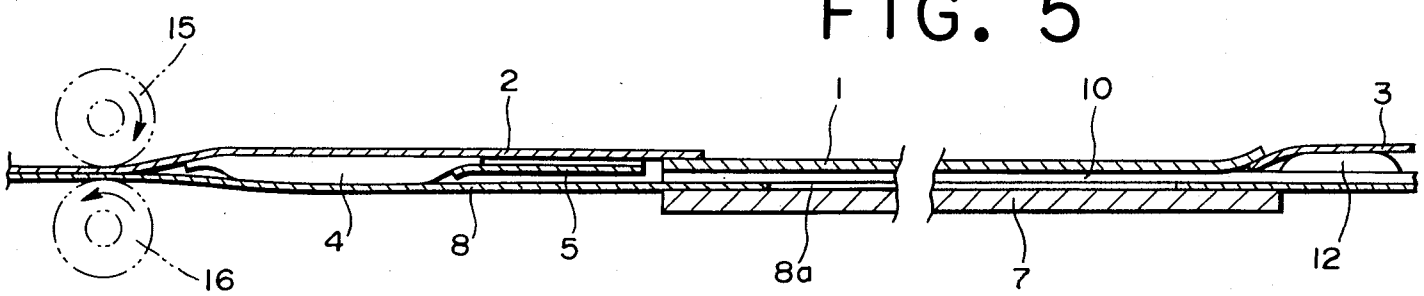
FIG. 5 is a developed sectional view of a film unit.

FIG. 5 shows a film unit which is developed or unfolded. As mentioned hereinbefore a plurality of film units are contained in a film pack which includes a spring-urged pressure plate for placing the photosensitive sheets in exposure position. After the photosensitive sheet 1 has been exposed to scene light, the tab 6 is pulled in order to withdraw the carrier sheet 2 out of the film pack. With the withdrawal of the carrier sheet 2, the mask 8 is gradually superposed on the carrier sheet 2 leading end first and moved toward an exit slot of the film pack, while the photosensitive sheet 1 is drawn toward the pressure plate. Adjacent the exit slot of the film pack, there is provided a pair of liquid spreading rollers 15, 16. When the tab 6 is pulled over the liquid spreading roller 15, the leading end of the carrier sheet 2 enters between the liquid spreading rollers 15, 16. After peeling apart the tab 6 from the carrier sheet which is effected by means of the liquid spreading roller 15, the leading end of the carrier sheet 2 is withdrawn from between the liquid spreading rollers 15, 16 for superposing the carrier sheet 2 and the mask 8 on each other and then the photosensitive and image receiving sheets 1, 7 in contact registration. When the carrier sheet 2 passes between the liquid spreading rollers 15, 16, the pod 4 is ruptured and releases the processing liquid between the two superposed portions through the funnel 5. The released processing liquid is distributed between the photosensitive and image receiving sheets 1, 7 superposed through the rails 9, 10 as the superposed sheets 1, 7 are advanced between the liquid spreading rollers 15, 16 for spreading the processing liquid in a thin, uniform layer. All of the excess processing liquid that is spread beyond the trailing ends of the sheets 1, 7 can be trapped and collected in a space defined by the trailer sheet 3, the mask 8 and the pair of plate-like projections 11, 13, where it gradually hardens.

Figure 1:
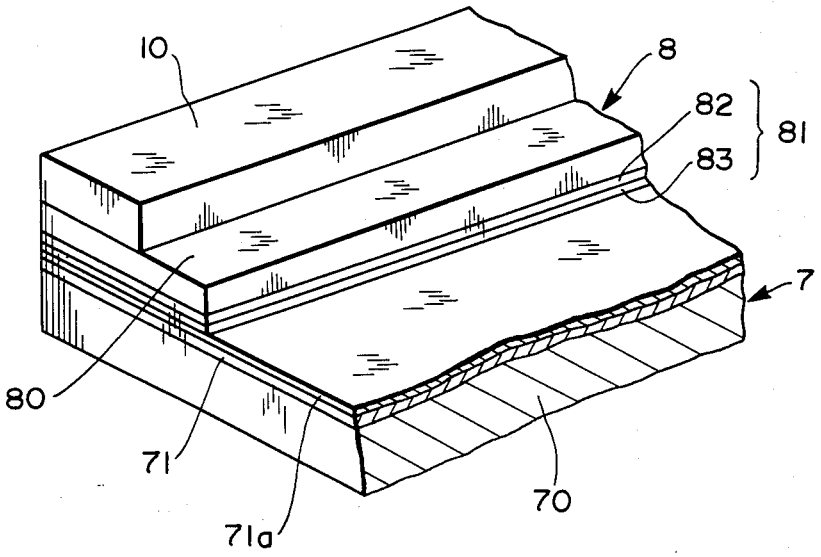
FIG. 1 is a fragmental perspective view, partly broken away to show layer structure, of a film unit of the invention.

Reference is now had to FIG. 1 partly showing the joined portion of the image receiving sheet 7 and mask 8 adhered to each other. The image receiving sheet 7 comprises a support 70 made of a flexible sheet material such as baryta paper and the like and a multilayer image receiving emulsion 71 coated on the support 70. The image receiving layer 71 includes a hydrophilic outermost layer 71*a* which acts to exfoliate the spread processing liquid from the image receiving sheet 7 when the latter is peeled apart from the photosensitive sheet 1. Example of hydrophilic polymer is an acrylic acid-butyl methacrylate copolymer for a color film unit, and an acrylic acid-butyl methacrylate copolymer mixed with a diisocyanate hardening agent or a wetting agent for a monochrome unit.

The mask 8 comprises a mask member 80 and a weak sealing layer 81 which is weak in the intensity of the seal. The mask member 80 is adhered to the image receiving sheet 7 through the weak sealing 81 in a heat sealing manner. The weak sealing layer 81 comprises a separating layer 82 and an adhesive layer 83 between which a weakened intensity of the seal is provided in order that an easy separation takes place therebetween when the mask 8 and image receiving sheet 7 are peeled apart from each other. On the mask member 80, a band-shaped rail 10 made of paper or plastics is firmly adhered in a heat sealing manner.

It is preferred to make the mask member 80 of paper sheet materials which have a high resistance to the permeation of processing liquid in order to prevent the processing liquid from permeating the weak sealing layer 81. In the event the mask member 80 is affected by the processing liquid and burrs are produced at places in the mask member 80, dapple developing marks will occur around the burrs. It is considered that the dapple developing mark results from the oxidation of air in a space formed by the burr. For this reason, the mask member 80 is required to have a high resistance to the permeation of processing liquid. To satisfy the requirement, the following materials are preferred:

(a) Polyethylene compounded paper: The paper contains 1–12% w/w of polyethylene and has 30 to 40μ thickness.

(b) Polyethylene compounded paper with styrene acryl size: The stylene acryl size is added in for the purpose of controlling the permeation of processing liquid. A processing liquid-resistance of the mask member can be improved by adding about 1–12 w/w of polyethylene in the raw paper material. The paper sheet has 30–40μ thickness. As such raw paper material, there is known WRP-40 (trade name: Tomoegawa paper Co., Ltd.).

Suitable for the mask member is the paper sheet mentioned in (b) and which contains 12% w/w of polyethylene and has 33μ thickness.

Used as a separation agent to be coated on the back surface of the mask member is a polymer which has a high alkaline resistance for controlling the permeation of processing liquid and a good separation property relative to the adhesive layer 83.

Examples of the polymer are mentioned as follows.

(a) Vinyl chloride-vinyl acetate copolymer:

A polymer, consisting of copolymerization of vinyl chloride and vinyl acetate, in which a content ratio thereof is 80–95% w/w of vinyl chloride and the remaining of vinyl acetate, is preferable. Example of the said vinyl chloride-vinyl acetate copolymer is 400×150M (trade name: Nippon Zeon Co., Ltd.) which contains 90% w/w of vinyl chloride and 10% w/w of vinyl acetate and has a mean degree of polymerization of 600.

(b) Poly-vinyl chloride:

(c) Polymethyl methacrylate:

Sumipex-B (trade name: Sumitomo Chemical Co., Ltd.).

(d) Vinyl chloride-vinyl acetate-vinyl alcohol ternary copolymer:

Vinylite VAGH (trade name: Union Carbide Corp.), (vinyl chloride; 91% w/w, vinyl acetate; 3% w/w, vinyl alcohol; 6% w/w).

(e). Vinyl chloride-vinyl acetate-malic acid ternary-copolymer:

Vinylite VMCH (trade name: Union Carbide Corp.), (vinyl chloride; 86% w/w, vinyl acetate; 13% w/w, maleic acid; 1% w/w).

(f) Methyl methacrylate (MMA) copolymer:

The said copolymer is represented by a general formula $\text{-}(\text{MMA})_x(\text{R})_y\text{-}$ wherein R is ethyl acrylate (EA), ethyl methacrylate (EMA), butyl acrylate (BA) or butyl methacrylate (BMA), x is 50–100 and y is 0–50.

(g) Polyvinylidene chloride:

SOA (trade name: Kureha Chemical Industry Co., Ltd.).

(h) Vinylidene chloride copolymer:

(i) Copolymer of poly-styrene or styrene (St) series:

Styrene series copolymer is represented by the general formula $\text{-}(\text{St})_x(\text{R})_y$ wherein R is methyl methacrylate (MMA), methyl acrylate (MA), ethyl acrylate (EA), ethyl methacrylate (EMA), butyl acrylate (BA) or butyl methacrylate (BMA), x is 50–100 and y is 0–50.

The most preferable example of the polymer is vinyl chloride-vinyl acetate copolymer in (a) hereinbefore.

To the separating layer 82 hereinbefore is preferably added an additive hereinbelow in order to control intensity of the seal.

(a) Fatty acid amide:

Preferable fatty acid amide is oleic acid amide and is added 1-5% w/w for the amount of solid part in the above releasing agent.

(b) Glycerol ester rosin or pentaerythritol ester rosin: Estergum H (trade name: Arakawa Chemical Industry Ltd.).

Among the various separating agents hereinabove, a combination of vinyl chloride-vinyl acetate copolymer 50-30% w/w and poly methyl methacrylate 50-70% w/w is preferable and a necessary exfoliation intensity can be controlled by this combination. Further oleic acid amide in (a) hereinabove can advantageously be added thereto with 3% w/w for solid part of the separating agent.

A thermoplastic polymer having hydrophilic —CONH—, —OH and other groups can be used for adhesive layer 83 hereinbefore in order to render it writeable to liquid-ink.

Examples of adhesives are mentioned as follows.

(a) Polyamide:

Examples of polyamide is a dimeric acid based polyamide, and is preferably DPX-1163, 1175, 1300, 1358 and Macromelte 6212 (trade name, Henkel-Hakusui Corp.).

(b) Low saponified polyvinyl alcohol (saponification value; 30-50 mol%, polymerization degree; 300-600):

Preferable examples are L5407 and L7514 (trade name: The Nippon Synthetic Chemical Industry Co., Ltd.).

(c) Polyvinyl acetate, vinyl acetate-maleic acid copolymer:

(d) Polyvinylpyrrolidone (PVP):

The adhesives (a) and (b) hereinabove can be used independently, however, in order to provide a good heat sealing property on the outermost layer 71*a*, a blend-polymer is preferably mixed in any one thereof. In general, blend-polymer is advantageously added in an amount of 5-50% w/w for base-polymer 95-50% w/w.

Example of blend-polymer is a copolymer of the following general formula (I):

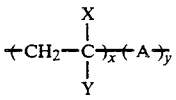

wherein X is hydrogen, halogen, cyano, or substituted or unsubstituted alkyl; Y is hydrogen, halogen, cyano, substituted or unsubstituted alkyl, aryl,

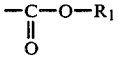

wherein $R_1$ is substituted or unsubstituted $C_{1-6}$ alkyl, or substituted or unsubstituted aryl,

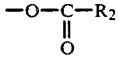

wherein $R_2$ is substituted or unsubstituted alkyl, or substituted or unsubstituted aryl,

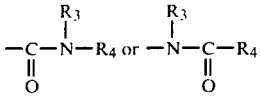

wherein $R_3$ and $R_4$ are hydrogen, substituted or unsubstituted alkyl, or substituted or unsubstituted aryl, and $R_3$ and $R_4$ can be the same or different; A is a repeating unit (monomer unit) derived from ethylenic unsaturated carboxylic acid, carboxylic acid salt thereof or carboxylic acid anhydride, which can be copolymerized with ethylenic series unsaturated monomer, respectively; and x and y are molar percentage of monomer component is copolymer, having the following relations:

$$x+y=100,\ 0<x<60 \text{ and } 40\leqq y<100$$

Examples of substituents for substituted alkyl or substituted aryl are hydroxyl, carboxyl, halogen (preferably chloride), cyano, alkyl or aryl.

Further most preferable examples of the copolymer (I) hereinbefore are shown as follows.

In the formula (I), X is hydrogen or substituted or unsubstituted $C_{1-4}$ alkyl;

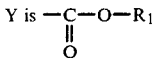

wherein $R_1$ is substituted or unsubstituted $C_{1-12}$ alkyl,

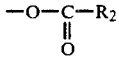

wherein $R_2$ is substituted or unsubstituted $C_{1-12}$ alkyl,

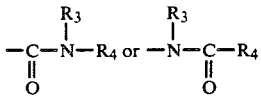

wherein $R_3$ and $R_4$ are hydrogen, substituted or unsubstituted $C_{1-12}$ alkyl, and are the same or different; and y is preferably 60-99, most preferably 70-90 in the molar percentage of monomer component.

In the above, the most preferable

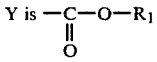

wherein $R_1$ is substituted or unsubstituted $C_{1-6}$, preferably $C_{3-5}$ alkyl in alkyl residue.

In the formula (I), A is a monomer of the formula (II) hereinbelow or maleic acid anhydride.

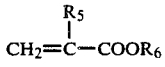

(II)

wherein $R_5$ is hydrogen, or substituted by hydroxyl, carboxyl, halogen (preferably chlorine), cyano or alkyl, or unsubstituted $C_{1-6}$ alkyl; and $R_6$ is $-R_4-O-\overset{\overset{O}{\|}}{C}-R_7-COOH$, hydrogen or $-R_4-O-R_8-COOH$, in which $R_4$ and $R_7$ are the same or different and are alkylene (preferably $C_{2-4}$ and most preferably ethylene), and $R_8$ is alkylene hereinabove or arylene (preferably phenylene). These groups can be further optionally substituted by the substituents hereinbefore.

A monomer of the formula (II) can be used in the form of salt. Examples of cation in the salt are alkali metal ion, alkaline earth metal ion or ammonium ion.

Examples of monomer are shown in the form of free acid as follows.

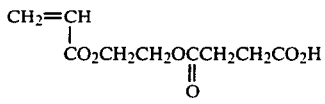

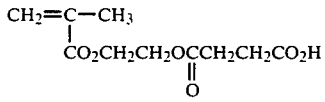

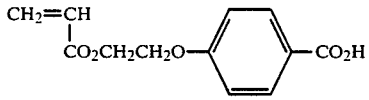

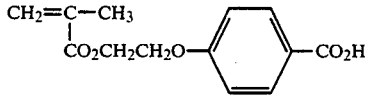

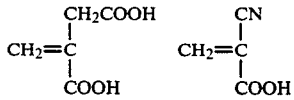

Among the monomer hereinabove, acrylic acid or methacrylic acid is preferable.

Examples of copolymer of the formula (I) are illustrated as follows. In the formula, copolymerization ratio is shown as molar percentage.

(a)

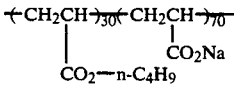

(b)

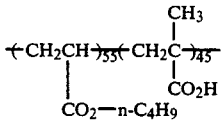

(c)

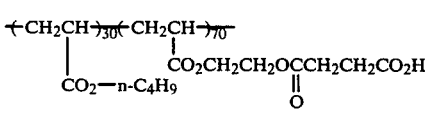

(d) acrylic acid - butyl methacrylate copolymer:

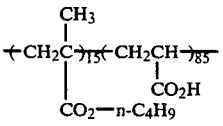

-continued (e)

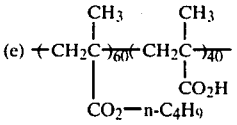

(f)

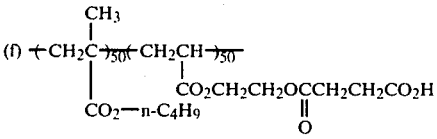

(g)

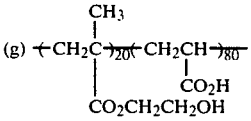

(h)

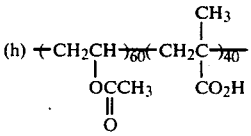

(i)

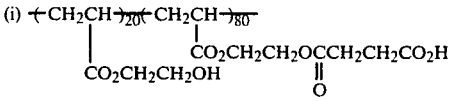

(j) styrene - acylic acid coploymer:

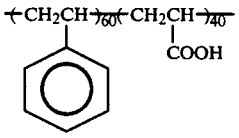

(k)

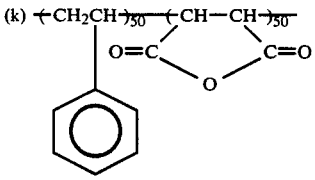

(l) ethyl methacrylate - acrylic acid copolymer:

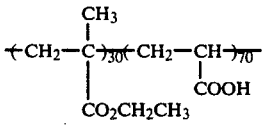

(m) ethyl acrylate - acylic acid copolymer:

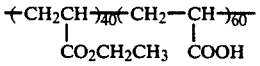

(n)

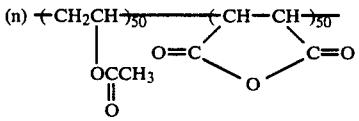

The blend-polymers hereinabove can be used either independently or mixed in any combinations, for adhesive agent.

For not only preventing the adhesive layer 83 from sticking to the corresponding back surface 82 of the mask member 80 when the mask 8 is rolled temporarily after being coated with the weak sealing layer 81 in a photogravure manner but also rendering the image receiving sheet writeable with pencils and inks, it is desirable to add a mat agent of silica to the adhesive agent. Silica which has an average perticle size of 2–5μ can be advantageously added with 5–20% w/w for solid part of the adhesive agent. Silica may be treated with organic or inorganic series chemicals, or not treated. However, inorganic series chemically treated silica is most preferable. Example is S-244 (trade name: Fuji-Davison Chemical Ltd.) for silica not treated, S-978 (trade name: Fuji-Davison Chemical Ltd.) for inorganic series chemically treated silica and OK-412 (trade name: Degussa Ag. West Germany) for organic series chemically treated silica.

Figure 2:
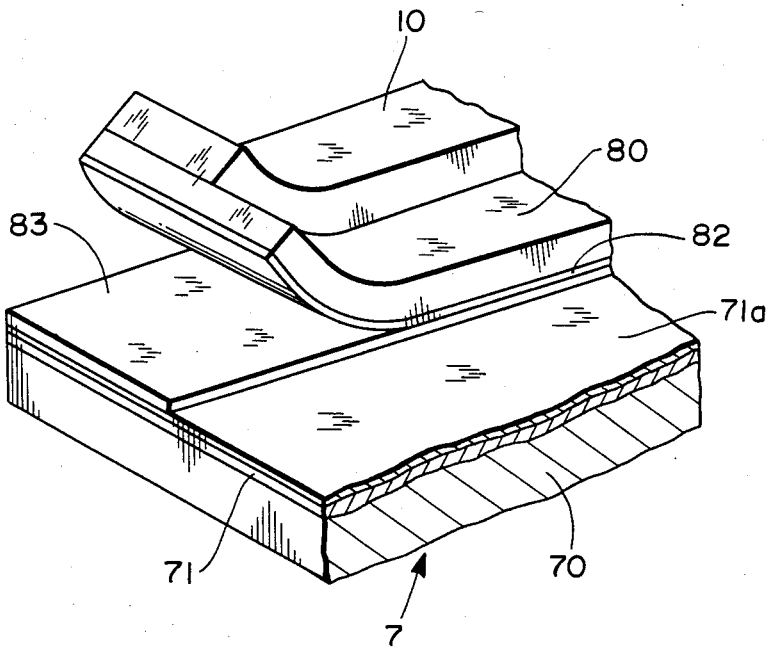
FIG. 2 is a fragmental perspective view of a film unit with a mask being separated from an image receiving sheet.

FIG. 2 shows the part of the image receiving sheet with the mask partly separated.

After a certain time, for example 45 seconds in the case of a monochromatic instant film unit, has elapsed, the mask 8 is peeled apart from the image receiving sheet 7. At this time, a separation takes place between the separating and adhesive layers 82, 83. As a result, the adhesive layer 83 is perfectly transferred to the image receiving sheet 7 so as to provide a white frame defining an image area on the image receiving sheet. Since the adhesive layer 83 has a hydrophilic outermost layer 71*a* which comprises a hydrophilic base-polymer and contains silica, the image frame is rendered writeable to inks of ball-point pen, water inks, oil inks and pencils.

Figure 3:
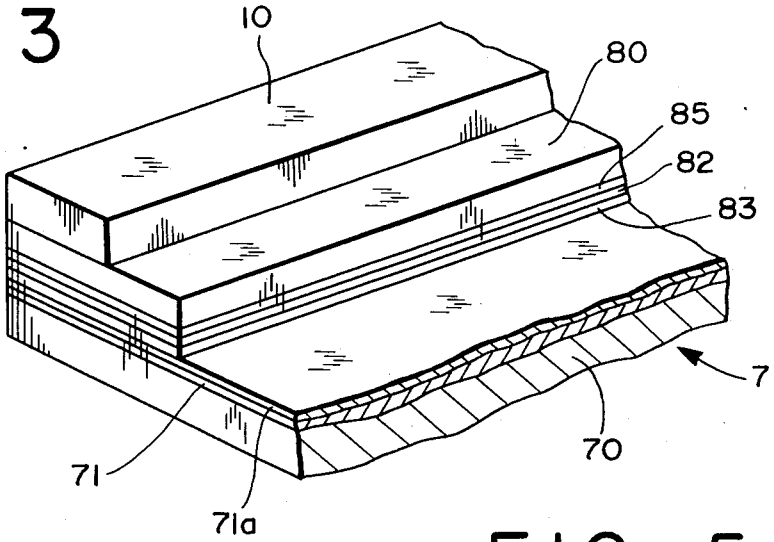
FIG. 3 is a fragmental perspective view, partly broken away to show layer structure including a processing liquid-resisting layer, of a film unit of the invention.

FIG. 3 shows a film unit provided with a processing liquid-resisting layer. Because of the fact that weak sealing layer 81 will swell when processing liquid permeates thereinto, the adhered strength of the adhesive layer 83 is reduced. For this reason, there is provided a processing liquid-resisting layer 85 having a fine alkaline resistance between the mask member 80 and the weak sealing layer 81. The processing liquid-resisting layer 85 comprises any polymers either individually or in mixture that are recited in regard to the separating layer 82. Specifically, vinyl chloride acetate copolymer is not proper. Some examples in accordance with the present invention are described hereinafter.

EXAMPLE 1

The mask member 80 was made of the paper sheet of 33μ thickness which contains styrene acryl size. The separating layer 82 was formed by coating a solution of methyl methacrylate polymer to the back surface of the mask 8. The dry weight of the coated amount of the separating agent was 2.0 g/m$^2$. The adhesive layer 21 was formed by coating a solution of polyamide polymer (DPX-1163) containing 20% w/w of the mat agent of silica (S-978) over the separating layer 20. The coated amount of the adhesive agent was 4.0 g/m$^2$ by dry weight. The above-mentioned mask 8 was heat sealed to the image receiving sheet 7 of a monochromatic film unit. The heat sealing was effected at a temperature within 100°–150° C. for 0.3 second, at a sealing pressure of 2.5 kg/cm$^2$. The heat sealing condition provided a sufficient intensity of the seal between mask 8 and the image receiving sheet 7 without any undesirable separations.

After 45 seconds, which is required for fully developing the monochromatic film unit, the mask 8 was finely separated with ease. Furthermore, the adhesive layer 83 was completely transferred to the image receiving sheet 7 so as to provide the image frame which has a fine appearance and is writeable to pencils, inks of ball-point pen, water inks, and oil inks.

EXAMPLE 2

The separating layer 82 was formed by coating a solution of 30% w/w of the vinyl chloride-vinyl acetate copolymer (400×150M) and 70% w/w of the polymethyl methacrylate polymer (MHO) to the back surface of the mask 8. The dry weight of the coated amount of the separating agent was 2.5 g/m$^2$. The same heat sealing condition as that of the example 1 was applied. This embodiment gave the separating layer 82 the same results as mentioned in example 1.

EXAMPLE 3

The mask member 80 was made of the paper sheet of 33μ thickness which comprises WRP paper material containing 12% w/w of SWP polyethylene (trade name: Mitsui Zerapak Co.) and a styrene acryl size. The separating layer 82 was formed by coating a solution of 40% w/w of vinyl chloride-vinyl acetate copolymer (400×150M) and 60% w/w of polymethyl methacrylate (MHO) on the back surface of the mask 8 in a photogravure manner. The dry weight of the coated amount of the separation agent was 2.5 g/m$^2$. The adhesive layer 83 was formed by coating a solution containing DPX-1163 polyamide added with organic series chemically treated S-978 silica of 20% w/w relative to the former on the separation layer in a photogravure manner. The coated amount of the adhesive agent was 4.0 g/m$^2$ by dry weight.

The mask 8 thus made was heat sealed to the image receiving sheet 7 of a monochromatic film unit. The heat sealing was effected at a temperature within 100°–150° C. for 0.3 second at a sealing pressure of 2.5 kg/cm$^2$. The heat sealing condition was suitable for providing a sufficient intensity of the seal between the mask 8 and the image receiving sheet 7 without undesirable separations.

Although the monochromatic film unit was left unseparated for ten minutes after the commencement of development, no burrs or deformations occurred in the mask member 80 and no dapple mark due to burrs and deformations in the mask member 80 were produced. When the mask 8 and the image receiving sheet 7 were peeled apart from each other, an easy separation was caused therebetween. According to visual observation, the adhesive layer 83 had been perfectly transferred to the image receiving sheet 7 and a fine image frame was provided. Furthermore, it was practically confirmed that the image frame was writeable to various kinds of inks.

EXAMPLE 4

The mask member 80 was made of the paper sheet of 33μ thickness which comprises paper material containing 12% w/w of SWP polyethylene and a styrene acryl size.

The separating layer 82 was formed by coating a solution of 15 parts of vinyl chloride-vinyl acetate copolymer in organic solvent of 51 parts toluene and 34 parts methyl ethyl ketone on the mask 8 in a photogravure manner. The dry weight of the coated amount of the separation agent was 2.0 g/m$^2$. The vinyl chloride-vinyl acetate copolymer was 400×150M of 600 degree of polymerization which contains 90% w/w of vinyl chloride. The adhesive layer 83 was formed by coating a solution of a base-polymer of polyamide and a blend-polymer of styrene acrylic acid copolymer in an organic solvent added with a mat agent of silica on the separating layer 82 in a photogravure manner. The dry weight of the amount of the adhesive agent was 3.6 g/m$^2$. The solution contained 10% w/w of DPX-1163 polyamide (trade name: Henkel Hakusui Corp.), 4% w/w of S-978 silica (trade name: Fuji-Davison Chemical Ltd.), and 10% w/w of styrene acryl copolymer which comprises styrene and acrylic acid in the ratio of 60:40 in mol percentage. An organic solvent comprising a mixture of 28% w/w of toluene, 56% w/w of n-propyl alcohol, and 10% w/w of water and a mixture of 45% w/w of ethyl alcohol and 45% w/w of methyl ethyl ketone was used.

For examining the effects of the above-mentioned separating layer 82 and adhesive layer 83, there were prepared three kinds of the hydrophilic outermost layers 71*a* of the image receiving layer 71, the first one being made from an acrylic butylmethacrylate copolymer (85 mol % of acrylic acid, 15 mol % of butylmethacrylate), the second being made from the above-mentioned acrylic butylmethacrylate copolymer mixed with 1–5% w/w of a diisocyanate hardening agent (2,2,6-trimethyl hexamethylenediisocyanate), and the other being made from an acrylic butylmethacrylate copolymer with a wetting agent and a mat agent added in, to each of which the above-mentioned adhesive layer 83 was heat sealed. The heat sealing was effected at temperature of 140° C., the sealing pressure, and the heat sealing time of 0.3 second.

The end of the mask 8 was bent backward and then pulled up for separation in order to examine the adhered strength of the adhesive layer 83 relative to each image receiving layer. As a result of the separation test, no separation was caused between the adhesive layer 83 and image receiving layer 71 through the hydrophilic outermost layer 71*a*, while the separating layer 82 was easily separated from the adhesive layer 83. This indicates that the respective hydrophilic outermost layers 71*a* have a strong heat sealing property relative to the adhesive layer 83.

EXAMPLE 5

The mask member 80 and separating layer were the same as that of the example 4. The adhesive layer was formed by coating a solution of 10% w/w of base-polymer of L 5407 polyvinyl alcohol (trade name: The Nippon Synthetic Chemical Industry Co., Ltd) with a low degree of saponification 10% w/w of a blend-polymer of styrene acrylic acid copolymer and 4% w/w of a mat agent of S-978 silica in an organic solvent. The dry weight of the coated amount of the adhesive agent was 3.4 g/m$^2$. The organic solvent was that containing 35% w/w of ethyl alcohol and 45% w/w of methyl ethyl ketone; the styrene acrylic acid copolymer comprising 60 mol % of styrene and 40 mol % acrylic acid was used.

As similar to the example 4, the adhesive layer 83 was heat sealed to each of three hydrophilic outermost layers 71*a* for examining the effects of adhesion between the above-mentioned separating and adhesive layers 82, 83. As a result of separation test, it was confirmed that the adhesive layer 83 was excellent in heat sealing property and that the adhesive layer 83 was perfectly transferred to the hydrophilic outermost layer 71*a*.

EXAMPLE 6

The mask member 80 was the same as that of the example 4. The processing liquid-resisting layer 85 was formed by coating a solution of vinyl chloride-vinyl acetate copolymer in an organic solvent to the mask 8 in a photogravure manner. The dry weight of the coated amount of the processing liquid-resisting material was 2.5 g/m$^2$. The solution was that containing 15 parts of 450×150M vinyl chloride-vinyl acetate copolymer of 600 degree of polymerization which has 90% w/w of vinyl chloride and the organic solvent containing 51 parts of toluene and 34 parts methyl ethyl ketone.

The separating layer 82 was formed by coating a solution of 6 parts of vinyl chloride-vinyl acetate copolymer, 9 parts polymethyl methacrylate, 0.45 part amide oleate in an organic solvent containing 51 parts toluene and 34 parts methyl ethyl ketone. The dry weight of the coated amount of the separation material was 1.3 g/m$^2$. 400×150M, Sumipex-B (trade name: Sumitomo Kagaku Kogyo Co.) and Armoslip CP power (trade name: Lion Akzo Co., Ltd.) were used for vinyl-chloride acetate, polymethyl methacrylate, and amide oleate, respectively. The adhesive layer 83 was formed by coating asolution of a base-polymer of 17 parts of polyamide, a blend-polymer of 3 parts of acrylate-butyl methacrylate (consisting of 85 mol % of acrylic acid and 15 mol % of butyl methacrylate) and 4 parts of S-978 silica in an organic solvent (consisting of 21 parts of toluene, 43 parts of n-propyl alcohol, 4 parts of water and 12 parts of ethylalcohol) to the separating layer 82 in a photogravure manner. The dry weight of the coated amount of the adhesive material was 4.0 g/m$^2$.

As similar to example 4, the adhesive layer 83 was heat sealed to each of three hydrophilic outermost layers 71*a* for observing the separation effects between the above-mentioned separating and adhesive layers 82, 83. As a result, it was confirmed that the adhesive layer 83 was excellent in heat sealing property and perfectly transferred to the hydrophilic outermost layer 71*a*.

What is claimed is:

1. In an instant film unit comprising: an image receiving sheet; a mask having an opening for defining an image area on said image receiving sheet, said mask being superposed on said image receiving sheet, said mask comprising an adhesive layer superposed on said image receiving sheet, a separating layer superposed on said adhesive layer, and a mask superposed on said separating layer; and a photosensitive sheet which, after exposure, is superposed on said image receiving sheet for spreading processing liquid therebetween; the improvement in which said adhesive layer comprises a thermoplastic polymer having hydrophilic groups and said separating layer comprises an alkali resistant polymer capable of separating from said adhesive layer.

2. A film unit as defined in claim 1, wherein said separating layer comprises vinyl chloride-vinyl acetate copolymer.

3. A film unit as defined in claim 2, wherein said copolymer consists of 80–95% w/w of vinyl chloride, the remainder being vinyl acetate.

4. A film unit as defined in claim 1, wherein said separating layer comprises polymethyl methacrylate.

5. A film unit as defined in claim 1, wherein said separating layer comprises a methyl methacrylate copolymer.

6. A film unit as defined in claim 1, wherein said separating layer comprises a mixture of vinyl chloride-vinyl acetate copolymer and polymethyl methacrylate.

7. A film unit as defined in claim 6, wherein said mixture consists of 30–50% w/w of vinyl chloride-vinyl acetate copolymer, the remainder being polymethyl methacrylate.

8. A film unit as defined in claim 7, wherein said mixture further comprises 3% w/w of amide oleate added thereto.

9. A film unit as defined in claim 1, wherein said adhesive layer comprises polyamide.

10. A film unit as defined in claim 9, wherein said polyamide contains silica added thereto.

11. A film unit as defined in claim 1, wherein said mask member is polyethylene compound paper.

12. A film unit as defined in claim 11, wherein said polyethylene compound paper contains 1–12% w/w of polyethylene for the solid part of row paper material.

13. A film unit as defined in claim 12, wherein said polyethylene compound paper contains 12% w/w of polyethylene for the solid part of row paper material.

14. A film unit as defined in claim 11, wherein said polyethylene compound paper further comprises a styrene-acrylic size added thereto in order to control the permeation of processing liquid thereinto.

15. A film unit as defined in claim 1, and a processing liquid-resisting layer being alkali resistant interposed between said separating layer and said mask member.

16. A film unit as defined in claim 15, wherein said processing liquid-resisting layer comprises a vinyl chloride-vinyl acetate copolymer.

17. A film unit as defined in claim 16, wherein said copolymer consists of 80–95% w/w of vinyl chloride, the remainder being vinyl acetate.

18. A film unit as defined in claim 15, wherein said processing liquid-resisting layer comprises polyvinyl chloride.

19. A film unit as defined in claim 15, wherein said processing liquid-resisting layer comprises polymethyl methacrylate.

20. A film unit as defined in claim 15, wherein said processing liquid-resisting layer comprises a mixture of a vinyl chloride-vinyl acetate copolymer and polymethylene methacrylate.

21. A film unit as defined in claim 20, wherein said mixture consists of 30–50% w/w of a vinyl chloride-vinyl acetate copolymer, the remainder being polymethyl methacrylate.

22. A film unit as defined in claim 15, wherein said processing liquid-resisting layer comprises a vinyl chloride-vinyl acetate-vinyl alcohol ternary copolymer.

23. A film unit as defined in claim 15, wherein said processing liquid-resisting layer comprises a vinyl chloride-vinyl acetate-malic acid ternary copolymer.

24. A film unit as defined in claim 15, wherein said processing liquid-resisting layer comprises a methyl methacrylate copolymer.

25. A film unit as defined in claim 15, wherein said processing liquid-resisting layer comprises vinylidene chloride.

26. A film unit as defined in claim 15, wherein said processing liquid-resisting layer comprises polystyrene or a copolymer thereof.

27. A film unit as defined in claim 1, wherein said adhesive layer comprises a mixture of a base polymer and at least one blend polymer, said base polymer being selected from the group consisting of polyamide and low saponified polyvinyl alcohol and said blend polymer being a copolymer of the following general formula:

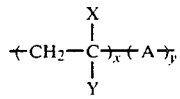

wherein X is selected from the group consisting of hydrogen, halogen, cyano, alkyl, and substituted alkyl; Y is selected from the group consisting of hydrogen, halogen, cyano, alkyl, substituted alkyl, aryl,

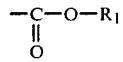

wherein $R_1$ is substituted or unsubstituted $C_{1-6}$ alkyl, or substituted or unsubstituted aryl;

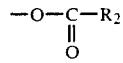

wherein $R_2$ is substituted or unsubstituted alkyl, or substituted or unsubstituted aryl;

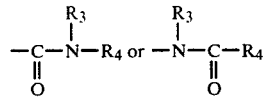

wherein $R_3$ and $R_4$ are hydrogen, substituted or unsubstituted alkyl, or substituted or unsubstituted aryl, and $R_3$ and $R_4$ can be the same or different; A is a repeating unit (monomer unit) derived from ethylenic unsaturated carboxylic acid, carboxylic acid salt thereof or carboxylic acid anhydride, which can be copolymerized with ethylenic series unsaturated monomer, respectively; and x and y are molar percentage of monomer component in copolymer, having the following relations:

$$x+y=100,\ 0<x<60 \text{ and } 40\leqq y<100$$

wherein substituents for substituted alkyl or substituted aryl are selected from the group consisting of hydroxyl, carboxyl, halogen, cyano, alkyl and aryl.

28. A film unit as defined in claim 27, wherein said blend-polymer of said general formula is a styrene-acrylic acid copolymer.

29. A film unit as defined in claim 27, wherein said blend-polymer of said general formula is an ethyl acrylate-acrylic acid copolymer.

30. A film unit as defined in claim 27, wherein said blend-polymer of said general formula is a methyl methacrylate-acrylic acid copolymer.

31. A film unit as defined in claim 27, wherein said blend-polymer of said general formula is a butyl methacrylate-acrylic acid copolymer.

32. An instant film unit including an image receiving sheet which is connected to a mask member having an opening for defining an image area in said image receiving layer through a weak sealing layer comprising a separating layer and an adhesive layer, and a photosensitive sheet which, after exposed, is superposed on said image receiving sheet for spreading processing liquid therebetween, wherein said mask member is made of a polyethylene compound paper sheet.

33. An instant film unit including an image receiving sheet which is connected to a mask member having an opening for defining an image area in said image receiving layer through a weak sealing layer comprising a separating layer and an adhesive layer, and a photosensitive sheet which, after exposed, is superposed on said image receiving sheet for spreading processing liquid therebetween, wherein there is provided between said mask member and weak sealing layer a processing liquid-resisting layer for which a polymer with a high alkaline resistance is used.

34. In an instant film unit comprising: an image receiving sheet; a mask having an opening for defining an image area on said image receiving sheet, said mask being superposed on said image receiving sheet, said mask comprising an adhesive layer superposed on said image receiving sheet, a separating layer superposed on said adhesive layer, said separating layer comprising an alkali-resistant polymer capable of separating from said adhesive layer, and a mask member superposed on said separating layer; and a photosensitive sheet which, after exposure, is superposed on said image receiving sheet for spreading processing liquid therebetween; the improvement in which said adhesive layer comprises a mixture of a base polymer and at least one blend polymer, said base polymer being selected from the group consisting of polyamide and polyvinyl alcohol with a low degree of saponification and said blend polymer being a copolymer of the following general formula:

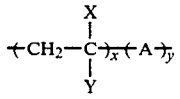

wherein X is selected from the group consisting of hydrogen, halogen, cyano, alkyl, and substituted alkyl; Y is selected from the group consisting of hydrogen, halogen, cyano, alkyl, substituted alkyl, aryl,

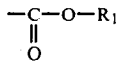

wherein $R_1$ is substituted or unsubstituted $C_{1-6}$ alkyl, or substituted or unsubstituted aryl;

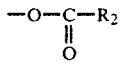

wherein $R_2$ is substituted or unsubstituted alkyl, or substituted or unsubstituted aryl;

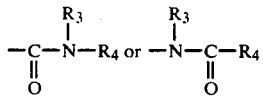

wherein $R_3$ and $R_4$ are hydrogen, substituted or unsubstituted alkyl, or substituted or unsubstituted aryl, and $R_3$ and $R_4$ can be the same or different; A is a repeating unit (monomer unit) derived from ethylenic unsaturated carboxylic acid, carboxylic acid salt thereof or carboxylic acid anhydride, which can be copolymerized with ethylenic series unsaturated monomer, respectively; and x and y are molar percentage of monomer component in copolymer, having the following relations:

$$x+y=100,\ 0<x<60 \text{ and } 40\leqq y<100$$

wherein substituents for substituted alkyl or substituted aryl are selected from the group consisting of hydroxyl, carboxyl, halogen, cyano, alkyl and aryl.

* * * * *